US005142827A

United States Patent [19]

Phillips

[11] Patent Number: 5,142,827

[45] Date of Patent: Sep. 1, 1992

[54] CRANKPIN GRINDER AND METHOD

[75] Inventor: James D. Phillips, Posen, Mich.

[73] Assignee: J. D. Phillips Corporation, Alpena, Mich.

[21] Appl. No.: 593,694

[22] Filed: Oct. 5, 1990

[51] Int. Cl.[5] ..... B24B 1/00

[52] U.S. Cl. ..... 51/281 R; 51/326; 51/328; 51/142

[58] Field of Search ..... 51/145 R, 144, 135 BT, 51/101 R, 105 EC, 135, 147, 281 R, 326, 328, 142

[56] References Cited

U.S. PATENT DOCUMENTS

| | | | |
|---|---|---|---|
| 1,660,291 | 6/1925 | Birkigt . | |
| 1,813,503 | 10/1927 | Merryweather . | |
| 1,843,301 | 9/1929 | Player et al. . | |
| 2,098,438 | 5/1932 | Stubbs . | |
| 2,195,054 | 8/1937 | Wallace et al. . | |
| 2,553,831 | 1/1949 | Musyl . | |
| 3,452,488 | 7/1969 | Palaski | 51/135 X |
| 3,760,537 | 9/1973 | Bovati . | |
| 4,091,573 | 5/1978 | Schmidt . | |
| 4,175,358 | 11/1979 | Bischeri | 51/145 R X |
| 4,292,767 | 10/1981 | Fatula . | |
| 4,382,727 | 5/1983 | Schmidt . | |
| 4,833,834 | 5/1989 | Patterson et al. | 51/147 |
| 4,945,683 | 8/1990 | Phillips | 51/145 R |

FOREIGN PATENT DOCUMENTS 2073069A 3/1981 United Kingdom .

*Primary Examiner*—M. Rachuba

*Attorney, Agent, or Firm*—Barnes, Kisselle, Raisch, Choate, Whittemore & Hulbert

[57] ABSTRACT

A method of grinding crankpin journals on a crankshaft in which the crankshaft is rotated about its central longitudinal axis. Abrasive belts are moved along paths substantially perpendicular to the crankshaft such that the abrasive surfaces of the belts grind the crankpin journals while the crankshaft rotates. The belts are guided independently of one another at the point of contact with the crankpin journals along a variable path according to the position of the crankpin journal around the central longitudinal axis of the crankshaft as the crankshaft rotates.

3 Claims, 4 Drawing Sheets

CRANKPIN GRINDER AND METHOD

This invention relates generally to grinding apparatus and refers more particularly to a method and apparatus for grinding the crankpin journals on a crankshaft by abrasive belts.

BACKGROUND

In accordance with present practice, the crankpin journals of a crankshaft are ground one at a time. The operation is carried out by rotating the crankshaft about the axis of one of the crankpin journals and grinding the surface of that crankpin journal with a grinding wheel while the crankshaft rotates. Before the next journal can be ground, the crankshaft must be indexed so that the next journal is placed on the axis of rotation. The indexing of the crankshaft and grinding of the crankpin journals one at a time is both time-consuming and cumbersome. Also, rotation of the crankshaft about an offset journal axis creates an imbalance which causes wear and sometimes results in imperfectly ground crankpin journals.

SUMMARY

In accordance with the present invention, the crankshaft is mounted once and once only for rotation about its own central axis. Then several of the crankpin journals are no need to index the crankshaft and since the crankshaft turns about its own central axis, imbalance is eliminated.

In accordance with a specific embodiment about to be described, a plurality of abrasive belts are supported adjacent to the crankshaft opposite several crankpin journals in positions to grind the crankpin journals while the crankshaft turns about its own central longitudinal axis. Each belt is individually guided at its point of contact with a crankpin journal along a variable path as the crankpin journal orbits around the central longitudinal axis of the crankshaft. The guiding of the belts is carried out by shoes which engage the back surfaces of the belts. Each shoe is moved toward and away from the crankshaft axis independently of the movement of the other shoes. Preferably, the rotative position of the crankshaft is monitored, and the shoes which guide the paths of the belts at their points of contact with the crankpin journals are CNC controlled so that the belts remain in constant contact with the crankpin journals as the crankshaft rotates.

An object of this invention is to provide a versatile and efficient grinding machine having the above features and which is also rugged, durable and efficient and of relatively simple manufacture and ease of operation; also to provide an improved method of grinding two or more crankpin journals at the same time.

Other objects, advantages and features of the invention will become more apparent as the following description proceeds, especially when considered with the accompanying drawings.

DETAILED DESCRIPTION

Figure 1:
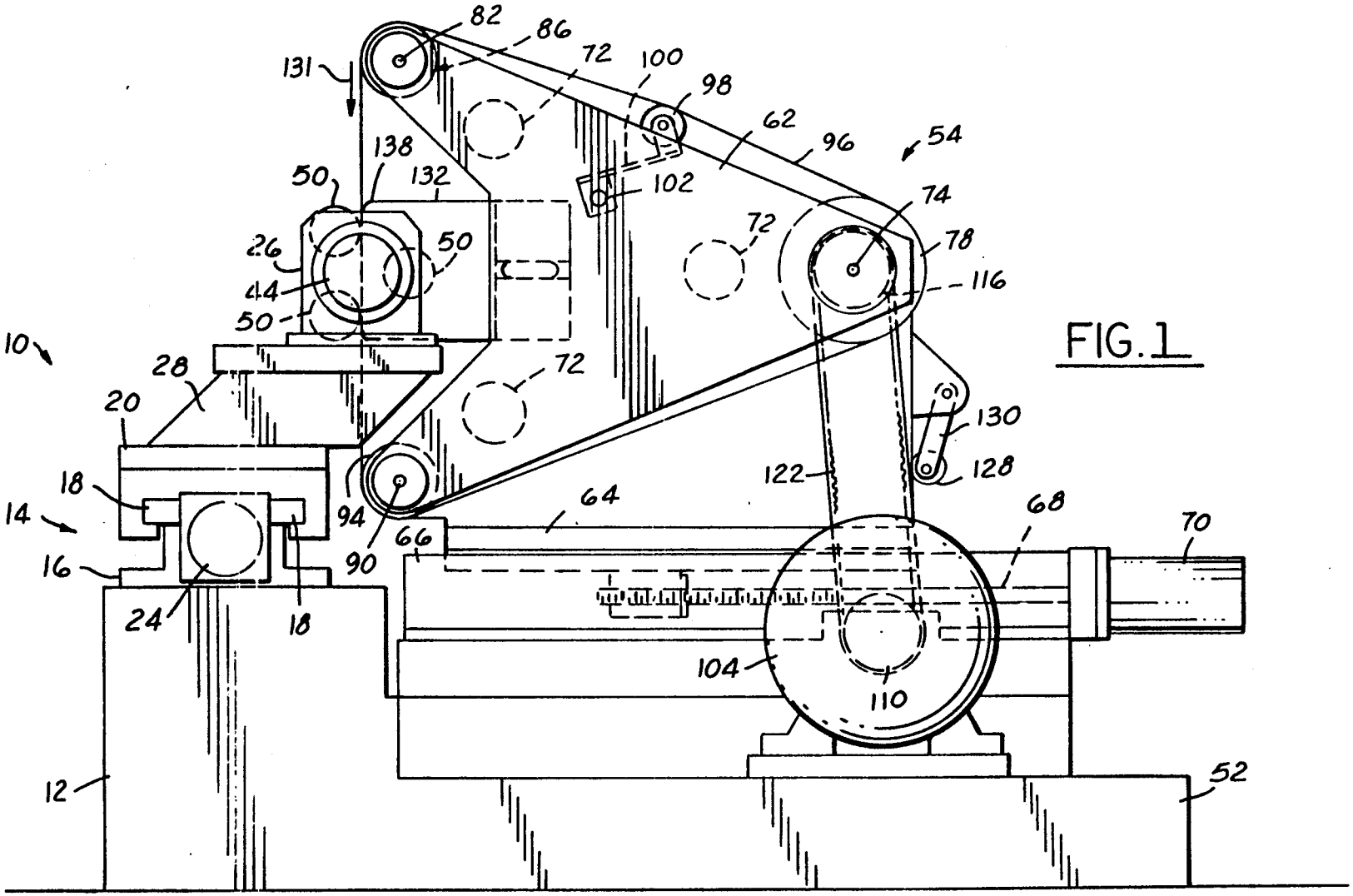
FIG. 1 is a side elevational view of apparatus constructed in accordance with the invention.
Figure 2:
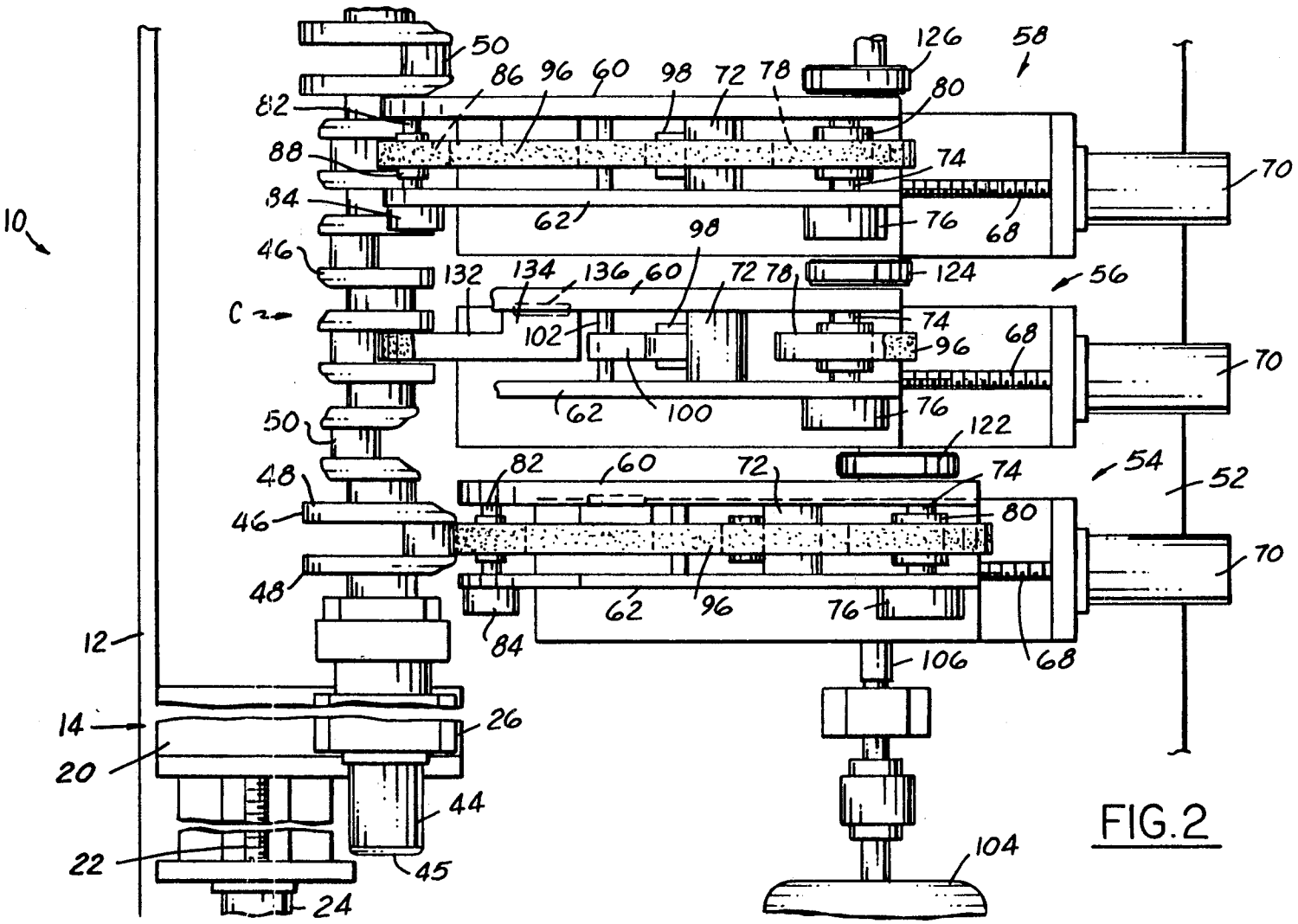
FIG. 2 is a top plan view, with parts broken away, of the apparatus shown in FIG. 1.
Figure 3:
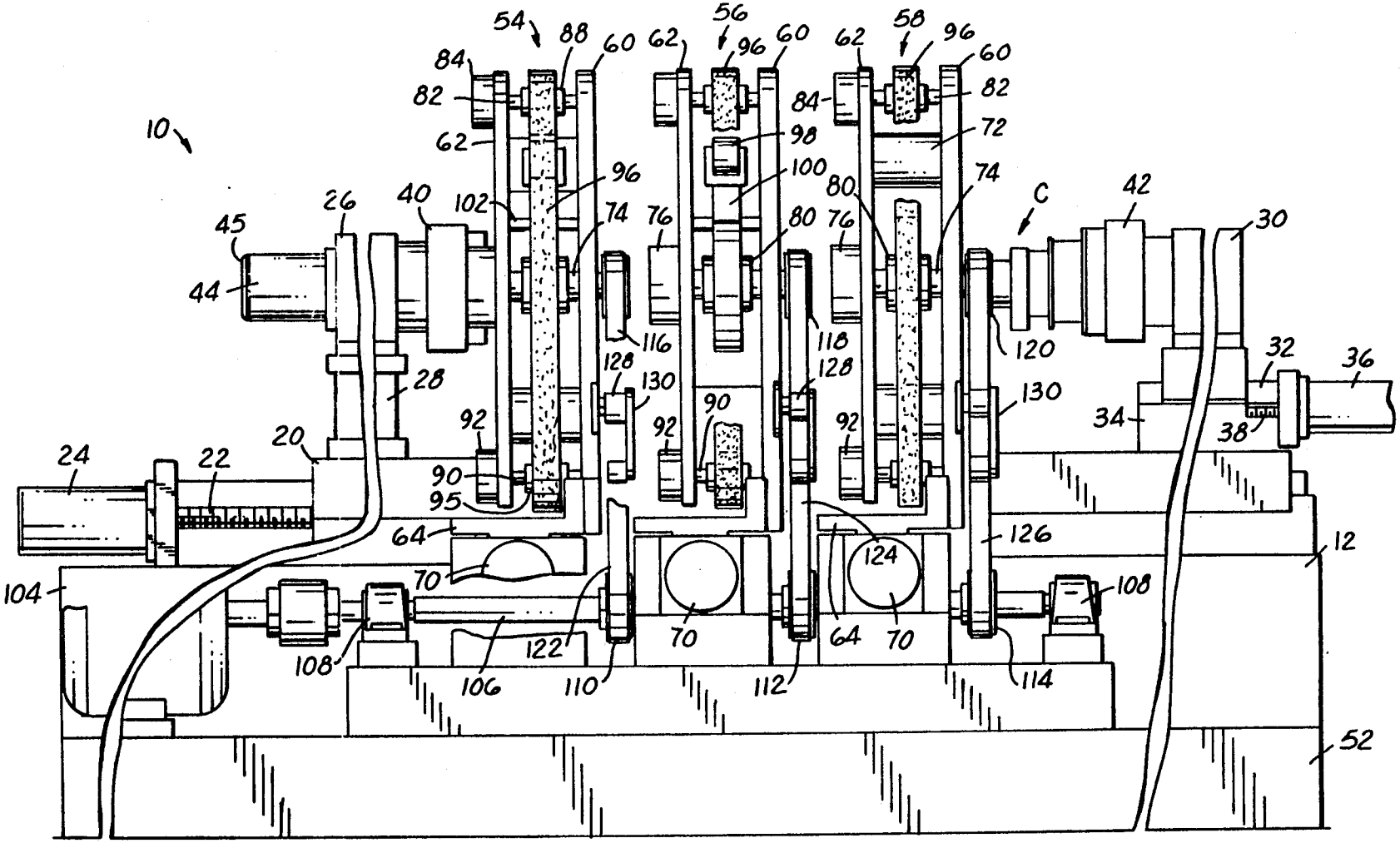
FIG. 3 is a rear view, with parts broken away.

Referring now more particularly to the drawings, the numeral 10 designates a grinding machine having a base 12 on which is mounted a slide assembly 14 for supporting a workpiece which in this instance is a elongated crankshaft C. The slide assembly comprises a slide base 16 which is rigidly secured to the grinding machine base 12. Parallel waybars 18 on slide base 16 slidably support a table 20 for movement along the waybars 18 by a ball screw drive 22 powered by a reversible motor 24. A headstock 26 is mounted on one end of the table 20 by a bracket 28. A tailstock 30 at the opposite end of the table is slidable on ways 32 mounted on a support 34 rigidly secured to table 20. The ways 32 are parallel to the waybars 18 to permit the tailstock to be adjusted toward and away from the headstock 26 by the servo motor 36 and ball screw drive 38. The ends of the crankshaft C are gripped by collet chucks 40 and 42 rotatably mounted on the headstock and tailstock, respectively A servo motor 44 mounted on the headstock drives collet chuck 40 to rotate the crankshaft C about its central, longitudinal axis.

The crankshaft C is an elongated member having crank arms 46 equally spaced apart along the length thereof which extend radially outwardly from the central axis of the crankshaft at different angles. Each crank arm has parallel side plates 48 which support a cylindrical crankpin journal 50 near the outer ends thereof. These crankpin journals 50 are cylindrical members whose axes are parallel to but radially offset from the central longitudinal axis of the crankshaft.

The base 12 has a lateral extension 52 on which a plurality, three in this instance, of grinding units 54, 56 and 58 are mounted. The grinding units are provided for the purpose of grinding the cylindrical surfaces of the crankpin journals 50 of the crankshaft.

Each grinding unit comprises a frame having a pair of laterally spaced parallel side plates 60 and 62 which are disposed in planes at right angles to the crankshaft C and to the waybars 18 supporting the table 20 on which the crankshaft C is mounted. The side plate 60 of each grinding unit is rigidly mounted on a saddle 64 which moves in ways 66 that are at right angles to the waybars 18 for the table 20. This saddle 64 is moved along its ways 66 by a ball screw drive 68 powered by a servo motor 70. The grinding units 54, 56 and 58 will be seen to be parallel to one another and to move along parallel paths.

The side plate 62 of each grinding unit is secured to the side plate 60 in the parallel relationship shown by suitable means including the spacer blocks 72. At the rear end of the side plates 60 and 62 of each grinding unit there is a shaft 74 which rotates in the side plates and also in a bearing block 76 mounted on the side plate 62. A belt pulley 78 is mounted on the shaft 74 between the side plates for rotation as a unit with the shaft and is held in place on the shaft by collars 80. At the upper front of each grinding unit there is a shaft 82 which rotates in the side plates 60 and 62 and in a bearing block 84 on the side plate 62. A belt pulley 86 is centered on shaft 82 for free rotation between collars 88. A similar shaft 90 at the lower front portion of each grinding unit rotates in the side plates 60 and 62 and also in a bearing block 92. On this shaft 90 is mounted for free rotation a belt pulley 94 centered between collars 95. An endless flexible abrasive belt 96 extends over the pulleys 78, 86 and 94, having an abrasive surface on the outer side and a non-abrasive backing surface on the inner side. The abrasive belt 96 is held under predetermined tension by a roller 98 mounted on the end of a leaf spring 100 the opposite end of which is secured to a shaft 102 extending between the side plates 60 and 62. The abrasive belts are disposed in planes perpendicular to the crankshaft C and the belts of the three units 54, 56 and 58 are spaced from each other a multiple of the distance between crank arms on the crankshaft, in this instance a multiple of 2.

The power for driving the abrasive belts of the three grinding units is provided by a motor 104 mounted on the base extension 52. The motor 104 rotates a shaft 106 supported for rotation on base extension 52 by the bearing blocks 108. Mounted at spaced points along the shaft 106 are three timing belt pulleys 110, 112 and 114 which are secured to the shaft and rotate as a unit therewith. The shaft 74 of each of the grinding units has an extension upon which timing belt pulleys 116, 118 and 120 are mounted. A timing belt is provided for each grinding unit. Thus a timing belt 122 extends over pulleys 110 and 116, a timing belt 124 extends over pulleys 112 and 118, and a timing belt 126 extends over pulleys 114 and 120. Associated with each timing belt is a belt tensioner comprising a roller 128 mounted on an arm 130 carried by the side plate 60 and urged by spring tension into contact with the timing belt. In this manner, the motor 104 provides the power for linearly moving the abrasive belts of all three grinding units in the direction of the arrow 131.

A shoe 132 is provided for each grinding unit for guiding the abrasive belt at the point where it contacts the crankpin of the crankshaft. This shoe has a mounting portion 134 secured where indicated to the side plate 60 by a key 136 and has a projecting nose portion 138 which bears against the back side of the abrasive belt between the idler pulleys 86 and 94.

The nose 138 is in the form of an elongated thin flat blade or plate which is disposed in the plane of the abrasive belt which it backs. The length of the nose 138 is greater than the diameter of the circle traversed by the journal pins when the crankshaft rotates so that the belt is backed by the nose 138 and held in contact with the journal pin continuously throughout the orbiting of the journal pin around the crankshaft axis. The front surface 140 of the nose is flat and perpendicular to the plane of the belt and contacts and guides the belt not only at its point of contact with the crankpin journal continuously throughout the orbiting thereof but also during the approach of the belt to the point of contact and its movement beyond the point of contact. The nose 138 has side surfaces 141 extending from opposite side edges of the front surface 140 which are perpendicular to the front surface and spaced apart a distance less than the width of the abrasive belt.

Figure 6:
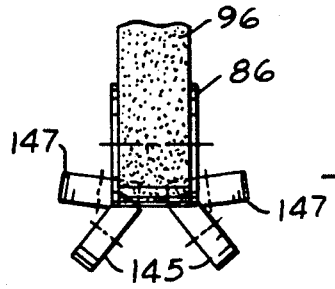
FIG. 6 is a view looking in the direction of the arrow 6 in FIG. 5.
Figure 5:
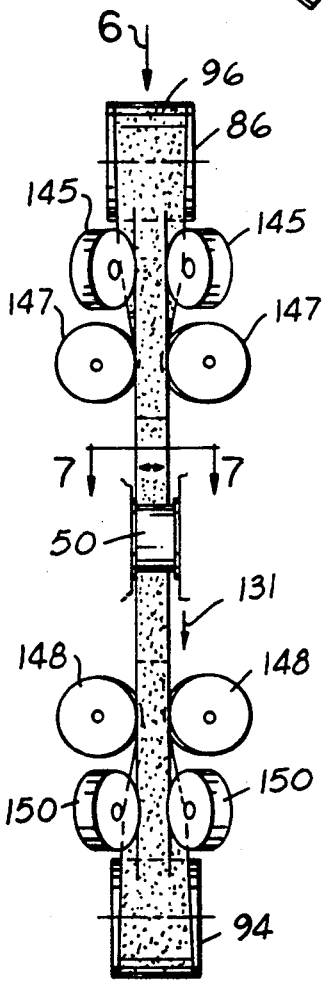
FIG. 5 is a view looking in the direction of the arrow 5 in FIG. 4.
Figure 4:
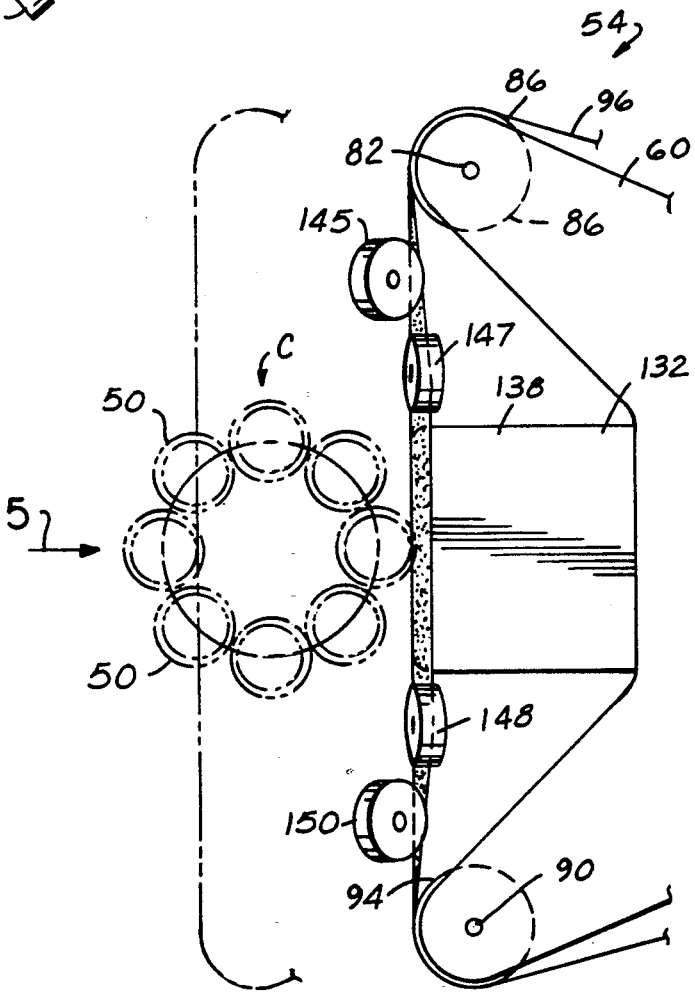
FIG. 4 is a fragmentary side view of a portion of FIG. 1 showing one of the crankpin journals in several positions around the axis of the crankshaft with the abrasive belt shown in solid lines in contact with the journal in one such position, the phantom lines indicating the position of the abrasive belt when in contact with that same journal in another of its positions.
Figure 7:
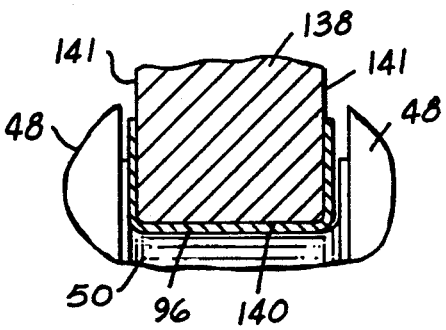
FIG. 7 is a fragmentary sectional view taken on the line 7—7 in FIG. 5.

Two sets of idler rollers 145 and 147 above nose 138 are provided for each grinding unit to fold the abrasive belt as it approaches the nose 138 from the normal flat condition to a generally U-shaped cross-section so that the belt as it traverses the nose extends over the front surface 140 thereof and its side edge portions are folded-back over the side surfaces 141 as seen in FIG. 7. These rollers 145 and 147 are mounted for rotation on the side plates 60 and 62. Rollers 145 and 147 can be seen in FIGS. 4–6 but have been omitted from FIG. 1 for clarity.

It will be observed in FIG. 7 that the total width of the nose plus the folded-back side edge portions of the abrasive belt is somewhat less than the width of the crankpin journal. If it is necessary to grind the full length of the periphery of the crankpin journal, then it may be necessary to oscillate the table 20 and crankshaft C during grinding. Oscillating the table 20 also will cause the folded-back portions of the abrasive belts to grind the inner surfaces of the side plates 48 of the crank arms 46.

The rollers 145 are set at an angle such that their peripheries are at about 45° to the abrasive surface of the belt as seen in FIG. 6 to begin the folding. The rollers 147 are set at an angle such that their peripheries are at about 90°, or preferably slightly more than 90°, to the abrasive surface of the belt, completing the folding in which the side edge portions of the belt are folded back 90° or slightly more than 90° so that when the belt reaches the nose 138 the side edge portions of the belt will have a slight gripping action and hug the sides of the nose.

Two sets of idler rollers 148 and 150 (also omitted in FIG. 1) below nose 138 are provided for each grinding unit to engage the abrasive belt after it moves beyond the nose 138. Rollers 148 and 150 are mounted for rotation on side plates 60 and 62. Rollers 148 are set at an angle such that their peripheries are at about 90° to the abrasive surface of the belt. These rollers 148 assist rollers 147 in maintaining the belt folded over the nose 138. Rollers 150 are set at an angle such that their peripheries are at about 45° to partially unfold the belt so that when the belt reaches roller 94 it will return to the normal completely flat condition.

The motors 70 for moving the grinding units 54, 56 and 58 toward and away from the crankshaft C are preferably driven and controlled by a CNC numerical control. A feed back device 45 on the motor 44 for rotating the crankshaft feeds back to the numerical control information regarding rotation of ball screw drive and hence the rotative position of the crankshaft, so that the numerical control will make corrections as necessary and operate the motors 70 of the grinding units to keep the abrasive belts in continuous contact with the crankpin journals being ground during crankshaft rotation.

In operation, the table 20 is moved by motor 24 to a position aligning three crankpin journals with the abrasive belts of the three grinding units 54, 56 and 58. The three grinding units are advanced by motors 70 to place the abrasive belts in contact with the crankpin journals. The crankshaft C is rotated by motor 44. Device 45 feeds back to the numerical control information regarding the rotative position of the crankshaft C. The numerical control individually drives the motors 70 of the three grinding units to maintain the abrasive belts in constant contact with the crankpin journals as the crankshaft rotates.

Upon completion of the rough or finish grinding of three crankpin journals, the grinding units are backed off, the table 20 is shifted to align another three crankpin journals with the abrasive belts of the three grinding units and the process is repeated.

If the crankpin journals are longer than the width of the folded abrasive belt, and it is desired to grind the full length of the crankpin journal, the table 20 may be oscillated during grinding.

What is claimed is:

1. A method of grinding is plurality of crankpin journals provided on the longitudinally spaced apart transverse arms of an elongated crankshaft in positions disposed laterally outwardly from the central longitudinal axis of said carnkshaft at different angles around said central, longitudinal the peripheries of a plurality of cylindrical crankpin journals provided in longitudinally spaced apart relation along the length of an elongated crankshaft wherein said crankpin journals are each mounted on a pair of longitudinally spaced apart arms extending radially outwardly from said crankshaft in positions such that the centers of said crankpin journals are disposed radially outwardly from the central longitudinal axis of said crankshaft at different angles around said central, longitudinal axis and a full 360° of the peripheries of said crankpin journals is laterally accessible for grinding, comprising supporting and rotating said crankshaft about said central longitudinal axis thereof causing said crankpin journals to orbit said central longitudinal axis, providing a plurality of flexible, abrasive belts each having an abrasive surface on one side and a backing surface on the side opposite said abrasive surface, supporting said belts laterally adjacent the crankshaft opposite the respective crankpin journals, driving said belts linearly along paths substantially perpendicular to said crankshaft, laterally moving the driven belts toward and away from said crankshaft in a manner such the abrasive surfaces of said belts continuously grind the peripheries of the orbiting crankpin journals while said crankshaft rotates including projecting said belts between said crankpin arms as necessary to grind a full 360° of the peripheries of said crankpin journals, and backing up each belt at its point of contact with a crankpin journal periphery continuously during the complete orbiting of said crankpin journals around said central longitudinal axis.

2. A method as defined in claim 1, including folding back the side edge portions of said belts in directions away from said crankshaft and grinding the inner confronting surfaces of the arms of each pair of arms when said belts are projected between said arms as aforesaid.

3. A method as defined in claim 2, including reciprocating said crankshaft longitudinally during rotation thereof to facilitate grinding the inner confronting surfaces of said arms by said folded back side edge portions of said belts.

* * * * *

UNITED STATES PATENT AND TRADEMARK OFFICE
CERTIFICATE OF CORRECTION

PATENT NO. : 5,142,827

DATED : September 1, 1992

INVENTOR(S) : James D. Phillips

It is certified that error appears in the above—identified patent and that said Letters Patent is hereby corrected as shown below:

Column 5, lines 9 - 14 delete "is plurality of crankpin journals provided on the longitudinally spaced apart transverse arms of an elongated crankshaft in positions disposed laterally outwardly from the central longitudinal axis of said carnkshaft at different angles around said central, longitudinal"

Signed and Sealed this

Fourteenth Day of June, 1994

Bruce Lehman

*Attest:*

BRUCE LEHMAN

*Attesting Officer*

*Commissioner of Patents and Trademarks*